US007731108B2

(12) United States Patent
Akabane et al.

(10) Patent No.: US 7,731,108 B2
(45) Date of Patent: Jun. 8, 2010

(54) ELECTROMAGNETIC FUEL INJECTION VALVE

(75) Inventors: Akira Akabane, Miyagi (JP); Kenichi Sato, Miyagi (JP)

(73) Assignee: Keihin Corporation, Tokyo (JP)

( * ) Notice: Subject to any disclaimer, the term of this patent is extended or adjusted under 35 U.S.C. 154(b) by 616 days.

(21) Appl. No.: 11/579,387

(22) PCT Filed: Oct. 6, 2005

(86) PCT No.: PCT/JP2005/010651

§ 371 (c)(1),
(2), (4) Date: Nov. 2, 2006

(87) PCT Pub. No.: WO2005/124142

PCT Pub. Date: Dec. 29, 2005

(65) Prior Publication Data

US 2008/0251613 A1 Oct. 16, 2008

(30) Foreign Application Priority Data

Jun. 16, 2004 (JP) ..... 2004-178642

(51) Int. Cl.
*B05B 1/30* (2006.01)
*F16K 31/02* (2006.01)
*B21K 21/08* (2006.01)
*B23P 15/16* (2006.01)

(52) U.S. Cl. ..... 239/585.1; 239/585.4; 251/129.16; 29/890.142

(58) Field of Classification Search ..... 239/585.1, 239/585.4, 585.5; 251/129.16, 129.21; 29/890.142
See application file for complete search history.

(56) References Cited

U.S. PATENT DOCUMENTS 4,509,693 A * 4/1985 Nakai ..... 239/585.5

(Continued)

FOREIGN PATENT DOCUMENTS

JP 11-166461 A 6/1999

(Continued)

*Primary Examiner*—Len Tran
*Assistant Examiner*—Justin Jonaitis
(74) *Attorney, Agent, or Firm*—Arent Fox LLP

(57) ABSTRACT

An electromagnetic fuel injection valve is provided in which a cylindrical magnetic body is welded to a valve seat member having at the rear end thereof a tubular press-fit portion press-fitted into a front portion of the cylindrical magnetic body, a valve body is housed in the valve seat member while being spring-biased in a direction that seats the valve body on a valve seat, and a movable core facing a fixed core is coaxially connected to the valve body, wherein the valve seat member (10) includes the tubular press-fit portion (10*a*), a large diameter portion (10*b*) that has substantially the same outer diameter as the outer diameter of the cylindrical magnetic body (9), and an annular shoulder portion (10*c*) that is formed as a flat face perpendicular to the outer peripheral face of the tubular press-fit portion (10*a*) and provides a connection between the tubular press-fit portion (10*a*) and the large diameter portion (10*b*), an annular abutment receiving face (9*a*) at the front end of the cylindrical magnetic body (9) is formed so as to define a right angle relative to the inner peripheral face of the cylindrical magnetic body (9), the annular abutment receiving face (9*a*) abutting against the annular shoulder portion (10*c*) over substantially the entire face, and the front end of the cylindrical magnetic body (9) and the abutment portion of the valve seat member (10) are welded together along the entire periphery. This enables the thickness of the cylindrical magnetic body to be reduced, thus making it small and improving the responsiveness.

5 Claims, 3 Drawing Sheets

U.S. PATENT DOCUMENTS

| | | | | |
|---|---|---|---|---|
| 5,178,362 | A * | 1/1993 | Vogt et al. | 251/129.21 |
| 5,199,648 | A * | 4/1993 | Fujikawa | 239/585.4 |
| 6,367,720 | B1 * | 4/2002 | Okamoto et al. | 239/585.1 |
| 6,386,467 | B1 * | 5/2002 | Takeda | 239/585.5 |
| 6,758,420 | B2 * | 7/2004 | Arioka et al. | 239/585.4 |
| 2002/0084363 | A1 * | 7/2002 | Dallmeyer et al. | 239/585.1 |
| 2006/0084363 | A1 * | 4/2006 | Carlson, III | 451/5 |

FOREIGN PATENT DOCUMENTS

| | | | |
|---|---|---|---|
| JP | 2002-89400 | A | 3/2002 |
| JP | 2003-506626 | A | 2/2003 |

* cited by examiner

ELECTROMAGNETIC FUEL INJECTION VALVE

CROSS-REFERENCE TO RELATED APPLICATION

This application is a National Stage entry of International Application No. PCT/JP2005/010651 filed Jun. 10, 2005, the entire specification claims and drawings of which are incorporated herewith by reference.

TECHNICAL FIELD

The present invention relates to an electromagnetic fuel injection valve that includes a cylindrical magnetic body connected to a fixed core via a non-magnetic member having a circular cross-section, a valve seat member having a tubular press-fit portion at the rear end thereof, the tubular press-fit portion being press-fitted into a front portion of the cylindrical magnetic body, and the cylindrical magnetic body and the valve seat member being welded together, a valve body that can be seated on a valve seat provided on the valve seat member, the valve body being housed in the valve seat member while being spring-biased in a direction that seats the valve body on the valve seat, and a movable core having the rear end thereof facing the front end of the fixed core, the movable core being coaxially connected to the valve body.

BACKGROUND ART

An electromagnetic fuel injection valve is known from, for example, Patent Document 1, in which a large diameter hole is coaxially provided in a front portion of a cylindrical magnetic body so as to form an annular step portion facing forward, a ring-shaped stopper for restricting a moving end of a valve body on the side on which the valve body separates from a valve seat is inserted into the large diameter hole so as to abut against the annular step portion, a rear portion of a valve seat member is press-fitted into the large diameter hole so that the rear end of the rear portion abuts against the stopper, and corner portions formed from the front end of the cylindrical magnetic body and the outer periphery of the valve seat member are welded together along the entire periphery.

Patent Document 1:

Japanese Patent Application Laid-open No. 2002-89400

DISCLOSURE OF THE INVENTION

Problem to be Solved by the Invention

However, in the above-mentioned conventional arrangement, it is necessary to set a relatively large thickness for the cylindrical magnetic body in order to form the annular step portion against which the stopper abuts, and if the outer diameter of the cylindrical magnetic body is increased in order to ensure a large thickness, the dimensions of the electromagnetic fuel injection valve inevitably increase. If, on the other hand, the outer diameter of the cylindrical magnetic body is set so as to be relatively small in order to reduce the dimensions of the electromagnetic fuel injection valve, the front portion of the cylindrical magnetic body becomes thin, thermal distortion during welding to the valve seat member increases, and the coaxial precision of the cylindrical magnetic body is thereby degraded. Furthermore, the structure with which the valve seat member is made to abut against the stopper requires a large number of components, the coaxial precision will be degraded unless the precision of each component is enhanced, and it is also disadvantageous in terms of cost. When the coaxial precision is degraded, in particular in an arrangement in which movement of an integrally connected valve body and movable core is guided via two positions that are axially separated, it is necessary to set a large guide clearance on the movable core side, and a side gap through which magnetic flux passes between the movable core and the cylindrical magnetic body increases, thus causing degradation in the responsiveness.

The present invention has been accomplished under the above-mentioned circumstances, and it is an object thereof to provide an electromagnetic fuel injection valve that enables the dimensions thereof to be reduced by making a cylindrical magnetic body thinner, and enables the responsiveness to be improved.

Means for Solving the Problem

In order to attain these objects, in accordance with a first aspect of the present invention, there is provided an electromagnetic fuel injection valve comprising: a cylindrical magnetic body connected to a fixed core via a non-magnetic member having a circular cross-section; a valve seat member having a tubular press-fit portion at the rear end thereof, the tubular press-fit portion being press-fitted into a front portion of the cylindrical magnetic body, and the cylindrical magnetic body and the valve seat member being welded together; a valve body that can be seated on a valve seat provided on the valve seat member, the valve body being housed in the valve seat member while being spring-biased in a direction that seats the valve body on the valve seat; and a movable core having the rear end thereof facing the front end of the fixed core, the movable core being coaxially connected to the valve body; characterized in that the valve seat member comprises the tubular press-fit portion, a large diameter portion that is formed so as to have a larger diameter than that of the tubular press-fit portion and substantially the same outer diameter as the outer diameter of the cylindrical magnetic body, and an annular shoulder portion that is formed as a flat face perpendicular to the outer peripheral face of the tubular press-fit portion and provides a connection between the tubular press-fit portion and the large diameter portion, the cylindrical magnetic body having at the front end thereof an annular abutment receiving face formed so as to define a right angle relative to the inner peripheral face of the cylindrical magnetic body, the annular shoulder portion abutting against the annular abutment receiving face over substantially the entire face when the tubular press-fit portion is press-fitted into the front portion of the cylindrical magnetic body, and the front end of the cylindrical magnetic body being welded to the abutment portion of the valve seat member along the entire periphery.

Further, in addition to the arrangement of the first aspect, in accordance with a second aspect of the present invention, there is provided an electromagnetic fuel injection valve, wherein the valve seat member is formed from a material having a higher hardness than that of the cylindrical magnetic body, and the front end of the cylindrical magnetic body and the abutment portion of the valve seat member are subjected to welding by a laser beam while offsetting an irradiation point of the laser beam toward the cylindrical magnetic body side relative to the position at which the front end of the cylindrical magnetic body and the valve seat member abut against each other.

EFFECT OF THE INVENTION

In accordance with the arrangement of the first aspect of the present invention, since the tubular press-fit portion at the rear end of the valve seat member is press-fitted into the front portion of the cylindrical magnetic body while making the abutment receiving face at the front end of the cylindrical magnetic body abut against the annular shoulder portion of the valve seat member over substantially the entire face, and in such a state the front end of the cylindrical magnetic body is welded to the abutment portion of the valve seat member along the entire periphery, in comparison with a conventional arrangement in which an annular step portion is formed within a cylindrical magnetic body, the cylindrical magnetic body can be made thinner, and it is possible to avoid an increase in the outer diameter of the cylindrical magnetic body, thus contributing to a reduction in the dimensions of the electromagnetic fuel injection valve. Moreover, since the abutment receiving face is formed so as to define a right angle relative to the inner peripheral face of the cylindrical magnetic body, the coaxiality is increased markedly, the magnetic efficiency is improved by enabling the guide clearance between the valve body and movable core and the valve seat member and cylindrical magnetic body to be reduced, and the responsiveness can thus be enhanced. Furthermore, since the front end of the cylindrical magnetic body and the abutment portion of the valve seat member, which have substantially the same outer diameters, are welded together along the entire periphery, it is possible to carry out welding where the thicknesses of the cylindrical magnetic body and the valve seat member are relatively large, thereby enabling the occurrence of thermal distortion from welding to be prevented.

Furthermore, in accordance with the arrangement of the second aspect of the present invention, it is possible to avoid the heat of the laser beam from being applied directly to the valve seat member, which has a relatively high hardness, thereby enabling the occurrence of cracking of the valve seat member during welding to be prevented.

DESCRIPTION OF THE REFERENCE NUMERALS AND CHARACTERS

Figure 1:
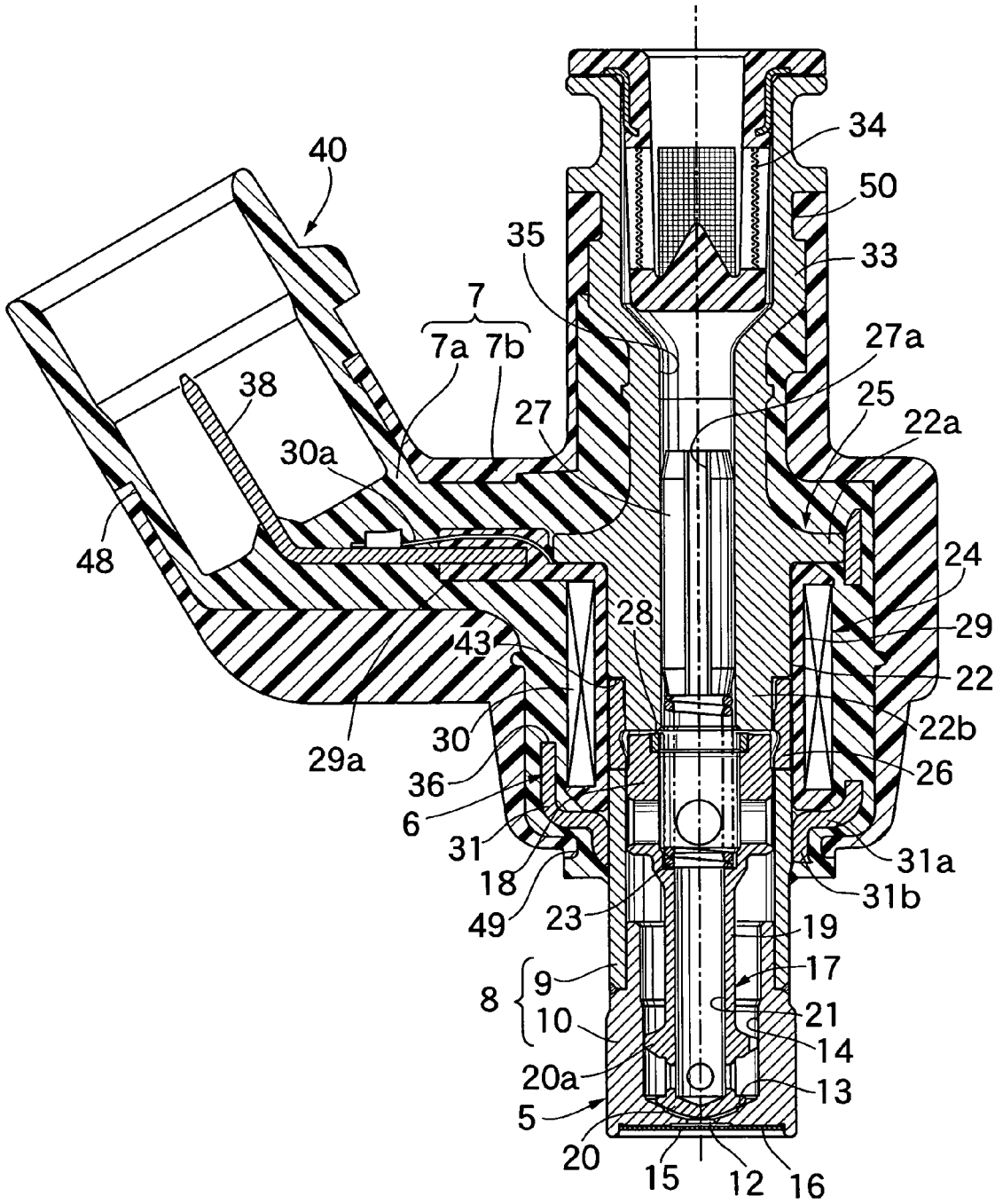
FIG. 1 is a vertical sectional view of an electromagnetic fuel injection valve (first embodiment).

9 cylindrical magnetic body
9*a* abutment receiving face
10 valve seat member
10*a* tubular press-fit portion
10*b* large diameter portion
10*c* annular shoulder portion
13 valve seat
18 movable core
20 valve body
22 fixed core
26 cylindrical non-magnetic body which is a non-magnetic member
B laser beam
P irradiation point

BEST MODE FOR CARRYING OUT THE INVENTION

A mode for carrying out the present invention is explained below by reference to one embodiment of the present invention shown in the attached drawings.

Embodiment 1

One embodiment of the present invention is explained by reference to FIG. 1 to FIG. 3; firstly in FIG. 1 an electromagnetic fuel injection valve for injecting fuel into an engine (not illustrated) includes a valve section 5 in which a valve body 20 is housed within a valve housing 8 having a valve seat 13 at the front end thereof, the valve body 20 being spring-biased in a direction that seats the valve body 20 on the valve seat 13, a solenoid section 6 in which a coil assembly 24 is housed in a solenoid housing 25 provided so as to be connected to the valve housing 8, the coil assembly 24 being capable of exhibiting an electromagnetic force for operating the valve body 20 so as to make it separate from the valve seat 13, and a synthetic resin covering section 7 having an integral coupler 40, connecting terminals 38 connected to a coil 30 of the coil assembly 24 facing the coupler 40, and at least the coil assembly 24 and the solenoid housing 25 being embedded in the covering section 7.

The valve housing 8 is formed from a cylindrical magnetic body 9 made of a magnetic metal and a valve seat member 10 that is joined in a liquid-tight manner to a front portion of the cylindrical magnetic body 9 by welding while in a press-fitted state. The valve seat member 10 is welded to the cylindrical magnetic body 9 in a state in which a rear end portion of the valve seat member 10 is fitted into a front end portion of the cylindrical magnetic body 9, and this valve seat member 10 is coaxially provided with a fuel outlet hole 12 opening on the front end face thereof, a tapered valve seat 13 connected to the inner end of the fuel outlet hole 12, and a guide hole 14 connected to a large diameter portion at the rear end of the valve seat 13 so as to guide the valve body 20. An injector plate 16 made of a steel plate is welded in a liquid-tight manner along its entire periphery to the front end of the valve seat member 10, the injector plate 16 having a plurality of fuel injection holes 15 communicating with the fuel outlet hole 12.

The solenoid section 6 includes a movable core 18, a cylindrical fixed core 22 facing the movable core 18, a return spring 23 exhibiting a spring force that urges the movable core 18 away from the fixed core 22, a coil assembly 24 disposed so as to surround a rear portion of the valve housing 8 and the fixed core 22 while being capable of exhibiting an electromagnetic force that allows the movable core 18 to be attracted to the fixed core 22 side against the spring force of the return spring 23, and a solenoid housing 25 surrounding the coil assembly 24 so that a front end portion of the solenoid housing 25 is connected to the valve housing 8.

The movable core 18 is slidably fitted into the rear portion within the valve housing 8, and the movable core 18 is coaxially joined to the valve body 20, which can be seated on the valve seat 13 so as to block the fuel outlet hole 12, thus forming a valve assembly 17. In this embodiment, the valve assembly 17 is formed from the movable core 18, a valve shaft 19 connected integrally to the movable core 18, and the valve body 20 formed integrally with the front end of the valve shaft 19, a through hole 21 is formed coaxially in this valve assembly 17, the through hole 21 communicating with the interior of the valve housing 8 and having a bottomed shape with its front end blocked, and the valve assembly 17 is urged by the return spring 23 in a direction that seats the valve body 20 on the valve seat 13.

Figure 2:
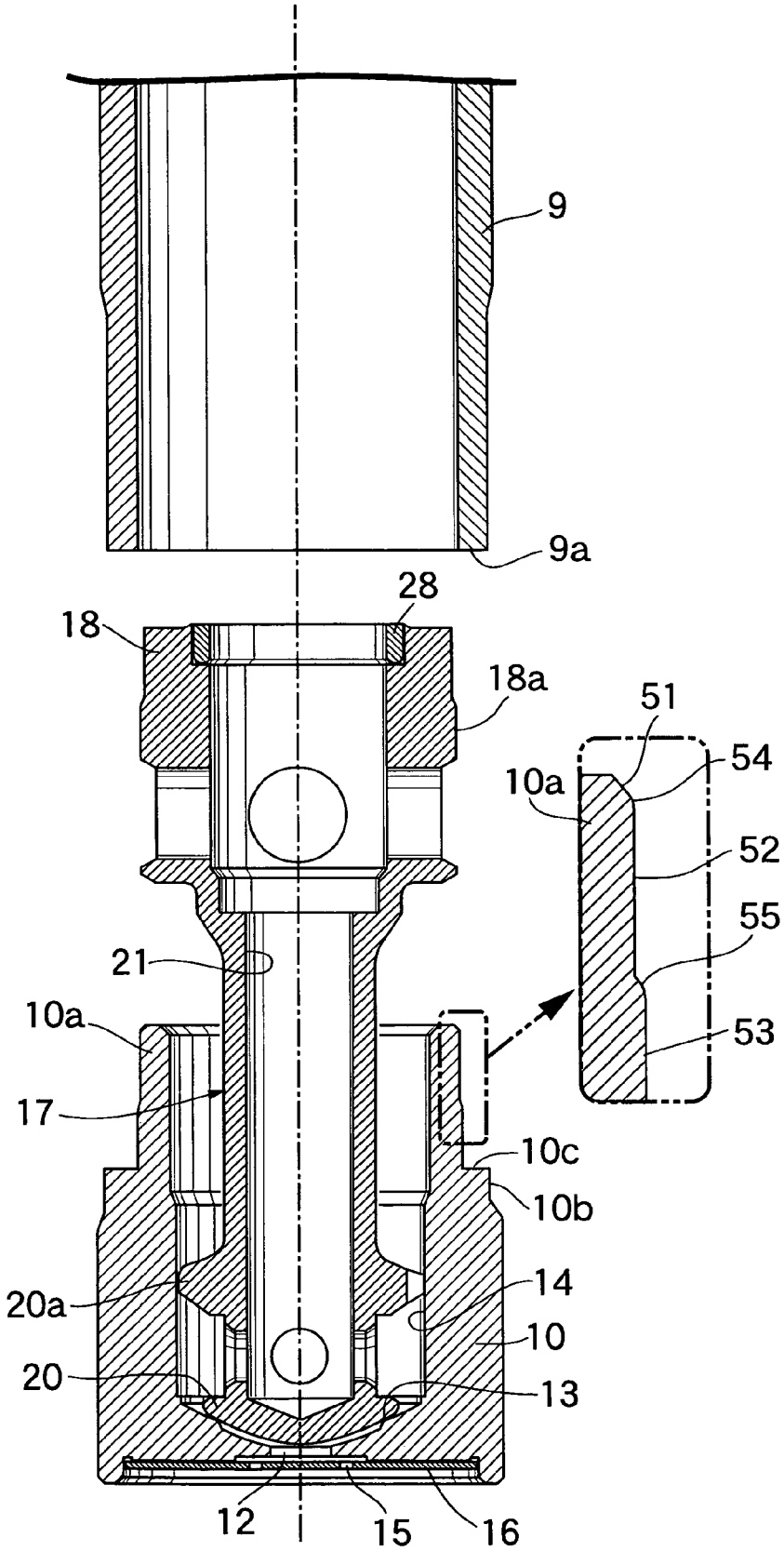
FIG. 2 is an exploded enlarged sectional view showing a structure with which a valve seat member is press-fitted to a cylindrical magnetic body (first embodiment).

Referring in addition to FIG. 2, the rear end of the cylindrical magnetic body 9 of the valve housing 8 is coaxially joined to the front end of the fixed core 22 via a cylindrical non-magnetic body 26, which is a non-magnetic member made of a non-magnetic metal such as stainless steel so as to have a circular cross-section, the rear end of the cylindrical magnetic body 9 is butt-welded to the front end of the cylindrical non-magnetic body 26, and the rear end of the cylindrical non-magnetic body 26 is welded to the fixed core 22 in a state in which a front end portion of the fixed core 22 is fitted into the cylindrical non-magnetic body 26.

A tubular retainer 27 is coaxially press-fitted into the fixed core 22, the tubular retainer 27 having one slit 27*a* extending in the axial direction and having a substantially C-shaped cross-section, and the return spring 23 is disposed between the retainer 27 and the movable core 18. In order to avoid the movable core 18 from being in direct contact with the fixed core 22, a ring-shaped stopper 28 made of a non-magnetic material is press-fitted into the inner periphery of a rear end portion of the movable core 18 so that the ring-shaped stopper 28 projects slightly from a rear end face of the movable core 18 toward the fixed core 22. Furthermore, the coil assembly 24 is formed by winding a coil 30 around a bobbin 29 surrounding a rear portion of the valve housing 8, the cylindrical non-magnetic body 26, and the fixed core 22.

The solenoid housing 25 is formed from a cylindrical magnetic frame 31 and a flange portion 22*a*, the cylindrical magnetic frame 31 being made of a magnetic metal in a cylindrical shape having at one end thereof an annular end wall 31*a* facing an end portion of the coil assembly 24 on the valve section 5 side and surrounding the coil assembly 24, the flange portion 22*a* protruding radially outward from a rear end portion of the fixed core 22 and facing an end portion of the coil assembly 24 on the side opposite to the valve section 5, and the flange portion 22*a* being magnetically coupled to the other end portion of the magnetic frame 31. Moreover, a tubular mating portion 31*b* is coaxially provided on the inner periphery of the end wall 31*a* of the magnetic frame 31, the cylindrical magnetic body 9 of the valve housing 8 being fitted into the tubular mating portion 31*b*, and the solenoid housing 25 is provided so as to be connected to the valve housing 8 by fitting the valve housing 8 into the tubular mating portion 31*b*.

A cylindrical inlet tube 33 is integrally and coaxially connected to the rear end of the fixed core 22, and a fuel filter 34 is mounted on a rear portion of the inlet tube 33. Moreover, a fuel passage 35 is coaxially provided in the inlet tube 33, the retainer 23, and the fixed core 22, the fuel passage 35 communicating with the through hole 21 of the movable core 18.

The covering section 7 is formed so as to embed not only the solenoid housing 25 and the coil assembly 24 but also a part of the valve housing 8 and a majority of the inlet tube 33 while filling in a gap between the solenoid housing 25 and the coil assembly 24, and a cutout portion 36 is provided in the magnetic frame 31 of the solenoid housing 25, the cutout portion 36 allowing an arm portion 29*a* formed integrally with the bobbin 29 of the coil assembly 24 to be disposed outside the solenoid housing 25.

The coupler 40 is provided integrally with the covering section 7, the connecting terminals 38 connected to opposite ends of the coil 30 of the coil assembly 24 facing the coupler 40, the base end of the connecting terminal 38 being embedded in the arm portion 29*a*, and coil ends 30*a* of the coil 30 being welded to the connecting terminals 38.

The covering section 7 is formed from a first resin molded layer 7*a* covering the solenoid housing 25 and forming part of the coupler 40, and a second resin molded layer 7*b* covering the first resin molded layer 7*a*. The first resin molded layer 7*a* on the extremity side relative to a middle portion of the coupler 40 is not covered by the second resin molded layer 7*b* but exposed to the outside, a rear portion of the inlet tube 33 is not covered by the second resin molded layer 7*b* but exposed to the outside and, furthermore, a portion of the first resin molded layer 7*a* corresponding to a rear portion of the valve housing 8 is not covered by the second resin molded layer 7*b* but exposed to the outside. Endless engagement channels 48 and 49 are formed in portions of the first resin molded layer 7*a* corresponding to the middle portion of the coupler 40 and the rear portion of the valve housing 8, end portions of the second resin molded layer 7*b* being engaged with the engagement channels 48 and 49, and an endless engagement channel 50 is provided on the outer periphery of the middle portion of the inlet tube 33, an end portion of the second resin molded layer 7*b* being engaged with the engagement channel 50. That is, the end portions of the second covering section 7*b* are made to interlock with the first covering section 7*a* and the inlet tube 33 via concavo-convex engagement.

The front end of the cylindrical non-magnetic body 26 is coaxially joined by butt-welding to the rear end of the cylindrical magnetic body 9 of the valve housing 8 so as to surround part of the movable core 18, and a front portion of the fixed core 22 is fitted into and fixed to a rear portion of the cylindrical non-magnetic body 26, the front end of the fixed core 22 facing the rear end of the movable core 18.

A small diameter mating portion 22*b* is coaxially provided on the front portion of the fixed core 22, the small diameter mating portion 22*b* having formed on the outer peripheral side thereof an annular step portion 43 facing forward, this small diameter mating portion 22*b* is fitted into the rear portion of the cylindrical non-magnetic body 26 until the step portion 43 abuts against the rear end of the cylindrical non-magnetic body 26 so that the small diameter mating portion 22*b* is in intimate contact with the inner face of a middle portion of the cylindrical non-magnetic body 26, and in this state the fixed core 22 is fixed by welding to the cylindrical non-magnetic body 26.

Referring in addition to FIG. 2, a guide portion 18*a* is provided in a middle portion of the movable core 18, the guide portion 18*a* being in sliding contact with an inner peripheral face of a rear portion of the cylindrical magnetic body 9, and the valve body 20 is provided with a journal portion 20*a* slidably fitted into an inner peripheral face of the valve seat member 10, that is, the guide hole 14.

The valve seat member 10 is provided with a tubular press-fit portion 10*a* that is press-fitted into the front portion of the cylindrical magnetic body 9, a large diameter portion 10*b* that is formed so as to have a larger diameter than that of the tubular press-fit portion 10*a* and substantially the same outer diameter as the outer diameter of the cylindrical magnetic body 9, and an annular shoulder portion 10*c* that is formed as a flat face perpendicular to the outer peripheral face of the tubular press-fit portion 10*a* and provides a connection between the tubular press-fit portion 10*a* and the large diameter portion 10*b*.

Moreover, the outer periphery of the tubular press-fit portion 10*a* is provided with, in sequence going from the extremity side, a tapered guide face 51 that guides insertion into the front portion of the cylindrical magnetic body 9, a coaxial adjustment face 52 having a cylindrical shape with a diameter larger than that of a large diameter portion of the guide face 51 and being capable of fitting into the inner peripheral face of the front portion of the cylindrical magnetic body 9, and a press-fitting face 53 that has a cylindrical shape with a larger diameter than that of the adjustment face 52 and is press-fitted into the inner peripheral face of the front portion of the cylindrical magnetic body 9; a first arc face 54 providing a connection between the guide face 51 and the adjustment face 52, and a second arc face 55 providing a connection between the adjustment face 52 and the press-fitting face 53 are also formed.

In accordance with the outer periphery of the tubular press-fit portion 10*a* being in such a shape, when press-fitting the tubular press-fit portion 10*a* into the cylindrical magnetic body 9, insertion into the cylindrical magnetic body 9 is first guided by the tapered guide face 51, subsequent fitting of the cylindrical adjustment face 52 into the inner periphery of the front portion of the cylindrical magnetic body 9 enables the coaxiality of the cylindrical magnetic body 9 and the tubular press-fit portion 10*a* to be guaranteed, and finally press-fitting the cylindrical press-fitting face 53 into the inner periphery of the front portion of the cylindrical magnetic body 9 enables the tubular press-fit portion 10*a* to be firmly press-fitted into the front portion of the cylindrical magnetic body 9 while ensuring high coaxiality.

Moreover, since a step portion between the guide face 51 and the adjustment face 52 and a step portion between the adjustment face 52 and the press-fitting face 53 are in an arc shape by virtue of the first and second arc faces 54 and 55, the first and second arc faces 54 and 55 exhibit the function of guiding the fitting of the following adjustment face 52 or press-fitting face 53 into the cylindrical magnetic body 9, and it is thereby possible to smoothly press-fit the tubular press-fit portion 10*a* into the cylindrical magnetic body 9 while maintaining accurate coaxiality between 10*a* and 9. Therefore, swarf is not generated, and it is possible to avoid the fuel passage being blocked by swarf.

An annular abutment receiving face 9*a* on the front end of the cylindrical magnetic body 9 is formed so as to define a right angle relative to the inner peripheral face of the cylindrical magnetic body 9, the annular abutment receiving face 9*a* abutting against the annular shoulder portion 10*c* over substantially the entire face thereof when the tubular press-fit portion 10*a* is press-fitted into the front portion of the cylindrical magnetic body 9.

Moreover, the right angle between the tubular press-fit portion 10*a* and the annular shoulder portion 10*c* of the valve seat member 10 is defined by grinding using the same grinding tool as when grinding the valve seat member 10, and the abutment receiving face 9*a* and the inner peripheral face of the front portion of the cylindrical magnetic body 9 are defined by grinding using the same grinding tool as when grinding the cylindrical magnetic body 9, and it is thereby possible to improve the precision of the right angle between the tubular press-fit portion 10*a* and the annular shoulder portion 10*c* and the right angle between the abutment receiving face 9*a* and the inner peripheral face of the front portion of the cylindrical magnetic body 9.

Figure 3:
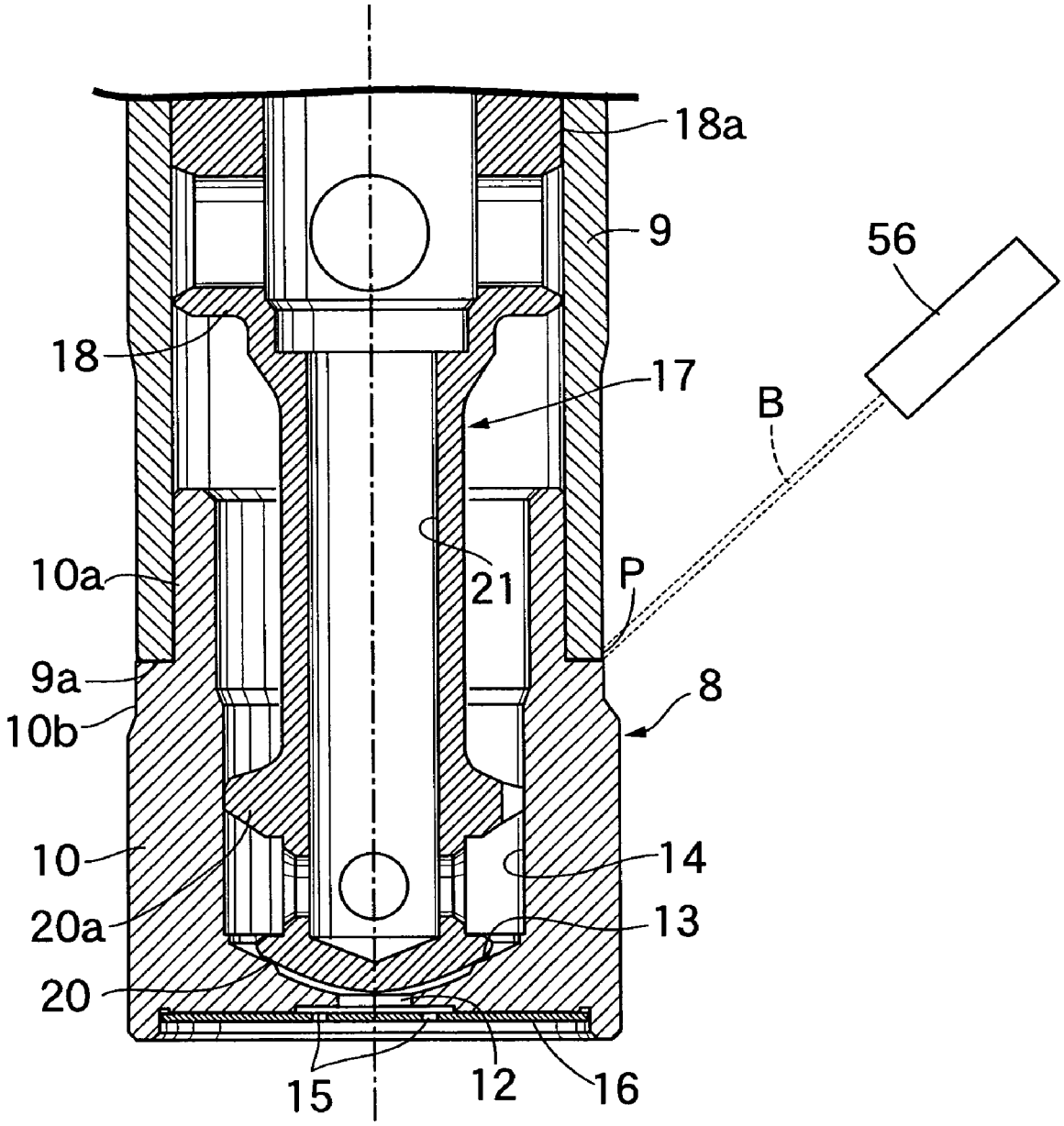
FIG. 3 is an enlarged sectional view showing a structure of a part where the cylindrical magnetic body and the valve seat member are welded (first embodiment).

Referring in addition to FIG. 3, the front end of the cylindrical magnetic body 9 and the abutment portion of the valve seat member 10 are welded along the entire periphery by a laser beam B. Moreover, the valve seat member 10 is formed from a material that has a higher hardness than that of the cylindrical magnetic body 9, for example SUS 440C, and while offsetting an irradiation point P of the laser beam B from a laser torch 56 toward the cylindrical magnetic body 9 side relative to a position at which the front end of the cylindrical magnetic body 9 and the valve seat member 9 abut against each other, the front end of the cylindrical magnetic body 9 and the abutment portion of the valve seat member 10 are subjected to welding by the laser beam B.

The operation of this embodiment is now explained. The valve seat member 10 is provided with the tubular press-fit portion 10*a*, which is press-fitted into the front portion of the cylindrical magnetic body 9, the large diameter portion 10*b*, which is formed so as to have a larger diameter than that of the tubular press-fit portion 10*a* and substantially the same outer diameter as the outer diameter of the cylindrical magnetic body 9, and the annular shoulder portion 10*c*, which is formed as a flat face perpendicular to the outer peripheral face of the tubular press-fit portion 10*a* and provides a connection between the tubular press-fit portion 10*a* and the large diameter portion 10*b*; the annular abutment receiving face 9*a* is formed at the front end of the cylindrical magnetic body 9 so as to define a right angle relative to the inner peripheral face of the cylindrical magnetic body 9, the annular abutment receiving face 9*a* abutting against the annular shoulder portion 10*c* over substantially the entire face thereof when the tubular press-fit portion 10*a* is press-fitted into the front portion of the cylindrical magnetic body 9, and the front end of the cylindrical magnetic body 9 and the abutment portion of the valve seat member 10 are welded along the entire periphery.

Therefore, compared with a conventional arrangement in which an annular step portion is formed in the interior of a cylindrical magnetic body, the cylindrical magnetic body 9 can be made thinner, and it is possible to avoid an increase in the outer diameter of the cylindrical magnetic body 9, thereby contributing to a reduction in the dimensions of the electromagnetic fuel injection valve. Moreover, since the abutment receiving face 9*a* is formed so as to define a right angle relative to the inner peripheral face of the cylindrical magnetic body 9, the coaxiality improves markedly, thus enabling the guide clearance between the valve body 10 and movable core 18 and the valve seat member 10 and cylindrical magnetic body 9 to be reduced and thereby improving the magnetic efficiency and the responsiveness. Furthermore, since the front end of the cylindrical magnetic body 9 and the abutment portion of the valve seat member 10, which have substantially the same outer diameter, are welded along the entire periphery, it is possible to weld the cylindrical magnetic body 9 and the valve seat member 10 together via relatively thick portions, thereby enabling thermal distortion from welding to be suppressed to a low level.

Furthermore, since the valve seat member 10 is formed from a material that has a higher hardness than that of the cylindrical magnetic body 9, and the front end of the cylindrical magnetic body 9 and the abutment portion of the valve seat member 10 are subjected to welding by the laser beam B while offsetting the irradiation point P of the laser beam B toward the cylindrical magnetic body 9 side relative to the position at which the front end of the cylindrical magnetic body 9 and the valve seat member 10 abut against each other, it is possible to avoid heat of the laser beam B from being applied directly to the valve seat member 10, which has a relatively high hardness, thereby preventing the valve seat member 10 from cracking during welding.

An embodiment of the present invention is explained above, but the present invention is not limited to the above-mentioned embodiment and can be modified in a variety of ways without departing from the spirit and scope of the present invention described in the claims.

The invention claimed is:

1. An electromagnetic fuel injection valve comprising:

a cylindrical magnetic body connected to a fixed core via a non-magnetic member having a circular cross-section and being disposed directly between opposing faces of the cylindrical magnetic body and the fixed core;

a valve seat member having a tubular press-fit portion at the rear end thereof, the tubular press-fit portion being press-fitted into a front portion of the cylindrical magnetic body, and the cylindrical magnetic body and the valve seat member being welded together;

a valve body that can be seated on a valve seat provided on the valve seat member, the valve body being housed in the valve seat member while being spring-biased in a direction that seats the valve body on the valve seat; and a movable core having the rear end thereof facing the front end of the fixed core, the movable core being coaxially connected to the valve body;

wherein the valve seat member comprises the tubular press-fit portion, a large diameter portion that is formed to have a larger diameter than that of the tubular press-fit portion and substantially the same outer diameter as the outer diameter of the cylindrical magnetic body, and an annular shoulder portion that is formed as a flat face perpendicular to the outer peripheral face of the tubular press-fit portion and provides a connection between the tubular press-fit portion and the large diameter portion, the cylindrical magnetic body having at the front end thereof an annular abutment receiving face formed to define a right angle relative to the inner peripheral face of the cylindrical magnetic body, the annular shoulder portion abutting against the annular abutment receiving face over substantially the entire face when the tubular press-fit portion is press-fitted into the front portion of the cylindrical magnetic body, and the front end of the cylindrical magnetic body being welded to the abutment portion of the valve seat member along the entire periphery.

2. The electromagnetic fuel injection valve according to claim 1, wherein the valve seat member is formed from a material having a higher hardness than that of the cylindrical magnetic body and the front end of the cylindrical magnetic body and the abutment portion of the valve seat member are subjected to welding by a laser beam (B) while offsetting an irradiation point (P) of the laser beam (B) toward the cylindrical magnetic body side relative to the position at which the front end of the cylindrical magnetic body and the valve seat member abut against each other.

3. The electromagnetic fuel injection valve according to claim 1, wherein the cylindrical magnetic body encompasses the tubular press-fit portion of the valve seat member.

4. An electromagnetic fuel injection valve comprising:

a cylindrical magnetic body connected to a fixed core via a non-magnetic member having a circular cross-section;

a valve seat member having a tubular press-fit portion at the rear end thereof, the tubular press-fit portion being press-fitted into a front portion of the cylindrical magnetic body, and the cylindrical magnetic body and the valve seat member being welded together, wherein the cylindrical magnetic body encompasses the tubular press-fit portion of the valve seat member;

a valve body that can be seated on a valve seat provided on the valve seat member, the valve body being housed in the valve seat member while being spring-biased in a direction that seats the valve body on the valve seat; and a movable core having the rear end thereof facing the front end of the fixed core, the movable core being coaxially connected to the valve body;

wherein the valve seat member comprises the tubular press-fit portion, a large diameter portion that is formed to have a larger diameter than that of the tubular press-fit portion and substantially the same outer diameter as the outer diameter of the cylindrical magnetic body, and an annular shoulder portion that is formed as a flat face perpendicular to the outer peripheral face of the tubular press-fit portion and provides a connection between the tubular press-fit portion and the large diameter portion, the cylindrical magnetic body having at the front end thereof an annular abutment receiving face formed to define a right angle relative to the inner peripheral face of the cylindrical magnetic body, the annular shoulder portion abutting against the annular abutment receiving face over substantially the entire face when the tubular press-fit portion is press-fitted into the front portion of the cylindrical magnetic body, and the front end of the cylindrical magnetic body being welded to the abutment portion of the valve seat member along the entire periphery.

5. The electromagnetic fuel injection valve according to claim 4, wherein the valve seat member is formed from a material having a higher hardness than that of the cylindrical magnetic body and the front end of the cylindrical magnetic body and the abutment portion of the valve seat member are subjected to welding by a laser beam (B) while offsetting an irradiation point (P) of the laser beam (B) toward the cylindrical magnetic body side relative to the position at which the front end of the cylindrical magnetic body and the valve seat member abut against each other.

* * * * *

UNITED STATES PATENT AND TRADEMARK OFFICE

CERTIFICATE OF CORRECTION

PATENT NO. : 7,731,108 B2
APPLICATION NO. : 11/579387
DATED : June 8, 2010
INVENTOR(S) : Akira Akabane et al.

It is certified that error appears in the above-identified patent and that said Letters Patent is hereby corrected as shown below:

TITLE PAGE -

In Item [22], PCT Filed Date, please correct to read as follows:

-- PCT Filed: June 10, 2005 --

Signed and Sealed this

Twenty-fourth Day of August, 2010

David J. Kappos

David J. Kappos
*Director of the United States Patent and Trademark Office*